US007525424B2

(12) United States Patent
Morse et al.

(10) Patent No.: US 7,525,424 B2
(45) Date of Patent: Apr. 28, 2009

(54) ILLUMINATED TRAIL MARKER APPARATUS

(75) Inventors: Jeffrey T. Morse, Goodrich, MI (US); Kevin C. Morse, Flint, MI (US)

(73) Assignee: Patented Technology Incorporated, Flint, MI (US)

( * ) Notice: Subject to any disclaimer, the term of this patent is extended or adjusted under 35 U.S.C. 154(b) by 230 days.

(21) Appl. No.: 11/504,747

(22) Filed: Aug. 15, 2006

(65) Prior Publication Data

US 2008/0042866 A1 Feb. 21, 2008

(51) Int. Cl.
*G08G 1/08* (2006.01)

(52) U.S. Cl. ..... 340/539.1; 340/573.4; 340/691.1

(58) Field of Classification Search ..... 340/691.1, 340/573.4, 539.1; 404/9; 362/276
See application file for complete search history.

(56) References Cited

U.S. PATENT DOCUMENTS

| | | | | |
|---|---|---|---|---|
| 3,564,495 | A * | 2/1971 | Gould | 340/944 |
| 3,685,482 | A | 8/1972 | Ryder | |
| 3,846,672 | A * | 11/1974 | Doughty | 315/312 |
| 4,523,717 | A | 6/1985 | Schwab | |
| RE33,470 | E | 12/1990 | Boy et al. | |
| 4,976,442 | A | 12/1990 | Treadway | |
| 5,000,111 | A | 3/1991 | Gibson | |
| 5,229,649 | A | 7/1993 | Nielson et al. | |
| D357,428 | S | 4/1995 | Lovelace | |
| 5,669,327 | A | 9/1997 | Beebe | |
| 5,699,065 | A | 12/1997 | Murray | |
| 5,782,552 | A * | 7/1998 | Green et al. | 362/183 |
| 6,232,887 | B1 * | 5/2001 | Carson | 340/903 |
| D445,710 | S * | 7/2001 | Lewis | D10/109 |
| 6,299,379 | B1 | 10/2001 | Lewis | |
| 6,474,851 | B1 * | 11/2002 | Baley | 362/477 |
| 6,593,845 | B1 | 7/2003 | Friedman et al. | |
| 6,712,286 | B2 | 3/2004 | Baxter et al. | |
| 6,873,257 | B2 | 3/2005 | Maloney et al. | |
| 6,953,845 | B2 * | 10/2005 | Tzikas et al. | 534/634 |
| 7,301,469 | B1 * | 11/2007 | Hoffman et al. | 340/815.54 |
| 2001/0044282 | A1 | 11/2001 | Lanza | |
| 2002/0152948 | A1 | 10/2002 | Percle | |
| 2004/0016786 | A1 | 1/2004 | Banda | |
| 2004/0061614 | A1 * | 4/2004 | Sulaver | 340/573.1 |
| 2004/0206294 | A1 | 10/2004 | Cavanaugh | |
| 2005/0006423 | A1 | 1/2005 | Kjeldsen et al. | |
| 2006/0023455 | A1 * | 2/2006 | Hardin | 362/253 |
| 2006/0054211 | A1 * | 3/2006 | Meyers | 136/246 |
| 2007/0153525 | A1 * | 7/2007 | Helget et al. | 362/276 |

* cited by examiner

*Primary Examiner*—Brent Swarthout
(74) *Attorney, Agent, or Firm*—J. Gordon Lewis

(57) ABSTRACT

A remotely actuated trail marker apparatus includes a transmitter unit designed to be carried by a hiker or hunter, which selectively broadcasts an interrogation signal throughout a predetermined range. One or more associated receiver units are adapted for pre-positioning at specific trail waypoints or a final destination. Each receiver unit generates a user sensible reply signal, such as self-illumination, in response to receiving the interrogation signal.

32 Claims, 9 Drawing Sheets

ILLUMINATED TRAIL MARKER APPARATUS

TECHNICAL FIELD

The present invention relates generally to apparatus employed for terrestrial navigation and particularly for defining a trail or destination in an otherwise remote locale. More particularly still, the present invention relates to markers suitable for pre-positioning at spaced waypoints to assist a user in retracing an earlier taken route.

BACKGROUND OF THE INVENTION

People often encounter great difficulty in marking trails when traveling in unfamiliar wooded areas or the like. The problem is particularly aggravated in the case of young or inexperienced individuals and/or those who have a poor sense of direction. Consequently, many people have become hopelessly lost because they failed to mark their trail and/or become totally confused in their sense of direction.

Heretofore, people traveling by foot relied on their sense of direction and/or memory (i.e. dead reckoning) when traveling over a trail in unfamiliar surroundings. Others have resorted to marking trails by breaking tree branches and/or setting up various signs by utilizing the natural materials found at hand, such as stones, branches, tree trunks and the like. However, the use of such natural material for marking trails frequently did not constitute a positive identification as such signs quickly lost their identity in the wilderness. Also such signs are easily overlooked, misunderstood or lost in their natural surroundings. Therefore, even though one attempted to mark trails by using the natural materials at hand, it did not assure such persons from becoming lost. The problem is even more aggravated if a hiker or camper planned an extensive trip into unknown wilderness, as for example, for several days, as the natural signs used for trail marking would tend to soon disappear, wash away or be altered by an animal or subsequent passer by. Thus, the natural materials heretofore utilized to mark a trail, at best, had only limited duration, and did not constitute a positive and lasting means to permanently mark a trail.

Hunters, hikers, explorers and participants in other outdoor activities often need or would like to know where they are or where they have been in a forest or other outdoor area. A hunter, for example, would like to be able to find his way back to a choice hunting location. He may want to let another hunter, who is to join him later, know where he is and what path he followed. A hunter may need to leave harvested game or equipment temporarily to obtain help to carry the game or equipment away, in which case, he needs to be able to find his way back to the spot of the kill relatively quickly.

Finding one's way outdoors traditionally is accomplished with the help of distinctive landmarks, such as a particular rock, a stream or an unusual tree. However, this can be very difficult if one is not familiar with the surrounding environment, or distinctive landmarks are lacking. Outdoor location identification is particularly difficult in the night, when natural landmarks are not easily visible due to low ambient light levels or are altered in appearance by shadows. Thus, hunters and outdoor sportsman will often mark their trail as they proceed to or from a particular location. The marked trail can easily be followed to/from the location by the sportsman at a later date or by others who follow.

A variety of devices and methods are known for marking trails outdoors. Typically, such methods involve placing permanent or removable marks or monuments on the ground, trees or other objects, or leaving a trail of markers on or in the ground, trees, etc. Reflective trail markers have become popular because they provide an inexpensive, easy method of marking trails and are highly visible at night when a light source is shined on them. Pieces of reflective tape, for example, are used to mark trails by placing the tape on trees or objects, but such tapes are often not easily securely applied and removed.

One type of reflective trail marker currently on the market resembles a thumbtack having a head, which is coated with a reflective coating, such as reflective paint. Such a marker can be pressed into a tree's bark easily with one hand. The ability to place a trail marker with only one hand is an important advantage, with one's hands usually occupied with other equipment or accessories when participating in outdoor activities. A series of such markers pressed into trees forms an easily visible trail. The reflective markers are made highly visible in the dark from a distance by shining light, e.g., a flashlight, onto them. However, the heads of these reflective markers are substantially flat, or form only a slight convex curvature. Thus, a light source must shine onto the head from a direction nearly perpendicular to the plane of the head for the reflected light to be visible to a person located at the light source. Also, such tacks can be difficult to remove from the trees or other structures in which they are placed. When employed on frequently used trails, such tacks can accumulate over time, by virtue of their being difficult to remove, and become an environmental eyesore or a misleading/distractive nuisance. Ornamental designs for similarly constructed trail markers are illustrated in U.S. Des. Pat. D445,710 to Lewis and U.S. Des. Pat. D357,428 to Lovelace.

Another reflective trail marker currently on the market resembles a tack having a cylindrical head, with the pin portion of the tack extending from one end of the cylinder. This type of trail marker is more easily placed in and removed from trees and other structures than the above described "thumbtack-type" marker. A reflective coating, of tape or paint, is placed substantially entirely about the cylindrical head. Such a reflective head reflects source light directly shined onto it from any angle (360° reflection). However, for any particular angle of incident source light, the actual reflective area can be effectively very small. Therefore, the reflective marker's effective reflective distance is always relatively short. Moreover, since the reflective head reflects source light shined onto it from any angle, a trail formed by such markers can be easily detected by shining a source light in the general area of the trail. This can be a disadvantage in some cases, such as where the person marking the trail (such as a choice hunting or fishing spot) wishes to keep the trail secret, and thus minimize the possibility of others discovering the trail. Reflective trail markers which reflect light in all directions (360° reflection) can also cause confusion in areas which are marked with several trails. A person shining a light into a forest with several trails marked with such (360° reflection) markers may simultaneously see reflections from markers belonging to different trails, making it difficult to discern the desired trail to be followed.

U.S. Pat. No. 6,299,379 to Lewis describes a trail marker having a generally "hour-glass" shaped marker head characterized by a central portion which is straddled by opposed end portions. The central portion of the marker head has one or more sidewall surfaces, which are light reflective. The sidewall surfaces of the marker head may be formed of a reflective material, or may be made reflective by applying reflective paint or tape thereto. The central portion of the marker head is formed to define four flat reflective sidewall surfaces at right angles to each other. This shape is characterized as enhancing the reflective surface area of the central portion of the marker head. The top and bottom cap portions of the marker head are non reflective, and extend beyond the sidewalls of the central portion. The non-reflective cap portions are stated to prevent illumination of and reflection from the central portion of the marker head at angles varying substantially from perpendicular to the reflective sidewall surfaces of the central portion along the axis of the central portion. A pin extends from one end of the marker head, to enable attachment of the marker to a support member, such as a tree.

The forgoing trail marker approaches, although having potential limited utility, all have shortcomings, in that they inherently reveal themselves to passers by, reflecting light emanating from any artificial or natural (i.e. sun, moon, lightening, etc.) source which happens to be fortuitously positioned with respect to the observer. This problem is particularly acute in environments, such as thickly grown forests, that contain few, if any, naturally occurring reflective surfaces. In such a situation, a reflected light in the distance naturally draws (unwanted) attention.

Another class of trail markers art is exemplified by U.S. Pat. No. 3,685,482 to Ryder and U.S. Patent Application Publication No.: 2002/0152948 to Percle. These devices typically employ a flexible, elongated member and means for fastening one end of the member to a fixed object such as a tree branch. Such markers can be brightly colored and tend to move with air currents to draw attention from any direction. Although inexpensive and easily attached, these markers are only visible with sufficient ambient light. Hours of dawn and dusk tend to create deep shadows, which can obscure or hide this type of marker. The use of such markers in a camouflage motif is also known for more clandestine applications. For example, see U.S. Pat. No. 6,712,286 to Baxter et al.

U.S. Pat. No. 5,000,111 to Gibson and U.S. Patent Application Publications 2004/0016786 to Banda, 2004/0206294 to Cavanaugh and 2005/0006423 to Kjeldsen each disclose a trail marking device including an elongated roll of brightly colored and/or reflective material which, in application, is carried by the trail blazer, who periodically severs a short length of the material and secures it at a waypoint along his trail.

U.S. Pat. No. 5,669,327 to Beebe describes a trail marking kit including a plurality of reusable colored tags which are made of special biodegradable material. Each tag contains means for attachment to a tree limb or the like to visually mark the trail to allow the user to return to his original destination by visually following the markers. The markers are sized for spacing of 100 or more yards there between, depending upon the density of the vegetation. Upon returning from the hike or journey, the user simply dislodges the previously placed markers from their respective fixed locations. After returning to the origin of the hike, the user will have retrieved all of the markers which may be reused at a later date. Alternately, if the used desires to mark a permanent or semi-permanent trail, the markers may be left in place for future hikes depending upon the user's intent and nature of the terrain. The use of biodegradable material allows the user to disregard markers which are not retrieved or are lost. They will simply biodegrade over time and disappear without any adverse environmental impact.

All of the forgoing prior art approaches require the user to pause at each waypoint and to study the terrain in order to locate the next waypoint. Although this may be easy in bright daylight and in open terrain, the onset of darkness and/or heavy undergrowth can make this more difficult. In low light conditions, the user must carry a light source (e.g. flashlight) and continuously scan its beam back and forth in his field of view in order to locate his next waypoint. This can be difficult when also carrying other equipment, a weapon and/or captured game. Furthermore, if the flashlight is inadvertently lost, damaged or its batteries fail, the upcoming trail markings are of little value. Lastly, the need to continuously scan a flashlight beam off into the distance in darkened terrain while walking an unknown trail can distract the attention of the user from upcoming snags, overhanging branches, obstacles and unseen hazards.

Electronic based navigation devices have largely supplanted the above-described devices, particularly in regards to vehicle (ground vehicle, boat, aircraft, etc.) related navigation. Satellite based global positioning systems (GPS) are extremely accurate and can be easily employed to pinpoint an object or individual anywhere on earth. Portable, hand-held GPS systems have recently become available which are suitable for hunters, hikers and the like. The major disadvantage of electronic based navigation devices is still size (difficult to fit in a pocket) and power requirements. Extra batteries and/or a power generator are required for extended treks in remote areas. In addition, such equipment tends to be fragile and can easily be damaged by rough handling or the egress of moisture or contaminates. Lastly, cost and complexity of operation can render known electronic based navigation devices prohibitive for many individuals and applications. Even a trained user must regularly divert his attention to the display and mentally calculate the coordinates of the next waypoint. This can be distracting and dangerous when walking in irregular, darkened and unknown terrain.

What is needed is an extremely compact and inexpensive trail marking apparatus that is robust, is simple to use (i.e. is "hands free"), has minimal electrical power requirements and can be employed in both clandestine and open trail/location marking modes.

SUMMARY OF THE INVENTION

An object of this invention is to provide a simple and inexpensive means by which trails through wilderness can be positively and permanently marked, but which employs marking devices, which are unobtrusive and easily camouflaged/concealed from detection by unauthorized passers by.

Another object of this invention is to provide a trail marker, which is specifically constructed for automatic, albeit clandestine usage so that it can be observed by authorized users at a substantial and pre-selectable distance and which can be precisely oriented and firmly secured in place.

In the preferred embodiment of the invention, a trail marker device is adapted for pre-positioning at a specific trail waypoint or destination and is operative to self-illuminate in response to an actuation signal. The trail marker device comprises a housing, a closure member which cooperates with the housing to define a substantially sealed cavity, a light source, a power supply and a control circuit which is at least partially disposed within the cavity and is operative to selectively electrically interconnect the light source and power supply to effect externally viewable illumination.

According to an aspect of the invention, the trail marker device control circuit includes a radio frequency receiver, which is operative to generate the actuation signal in response to receiving an interrogation signal from a remote transmitter. This arrangement has the advantage of effecting the remote illumination of one or more marker devices nearest the transmitter, which is carried by the hiker.

According to another aspect of the invention, the trail marker device includes a wake-up circuit and a timer operative to generate or disable the actuation signal at a predetermined time of day and/or for a predetermined time duration. This saves energy and extends the life of the battery within the trail marker device.

According to another aspect of the invention, the power supply of the trail marker device includes a photovoltaic device positioned to receive ambient light and to recharge an electrical energy storage device. This arrangement greatly enhances the operating life cycle of the trail marker device.

According to another aspect of the invention, the trail marker device includes an optical lens integrally formed with the closure member for simplicity of design and positioned adjacent the light source to focus and project light emitted by the light source within a predetermined viewing sector disposed about a focus axis. This allows light emitted from the trail marker device to be viewed only near a focus axis.

According to another aspect of the invention, a light reflector is disposed adjacent the lens and is configured to direct light received from the light source into the viewing sector. Furthermore, the reflector acts to reflect light received from a remote source in the viewing sector back along the viewing sector towards the remote source. This arrangement allows a flashlight carried by the hiker to be used to locate a non-functioning trail marker device.

According to another aspect of the invention, a hood is selectively affixable to the housing and positionable to selectively reduce or limit the viewing sector.

According to another aspect of the invention, fixation means such as a barbed nail or a screw extends from the trail marker device to enable securing it to a trailside object in a predetermined orientation. Preferably, the fixation means is elongated along an axis substantially concentric with the axis of said viewing sector. This feature allows "aiming" of the viewing sector of the trail marker device as it is being affixed to a trailside object.

According to another aspect of the invention, an outer surface of the trail marker device housing defines a tool-receiving surface adjacent to and spaced from the trailside object for receiving a pry-type removal tool. This simplifies the process of removing the trail marker device from the trailside object.

According to another aspect of the invention, a translucent light filter overlays the light source to effect the emission of substantially monochromatic light, preferably in the infrared, visible light and/or ultraviolet frequency ranges.

According to yet another aspect of the invention, a remotely actuated trail marker apparatus comprises a transmitter unit which is adapted to be carried by a user and operates to selectively broadcast an interrogation signal throughout a predetermined range. The trail marker apparatus also comprises one or more receiver units, each adapted for positioning at specific trail waypoints or a destination and operative to generate a user sensible reply signal in response to receiving the interrogation signal.

According to still another aspect of the invention, the interrogation signal is digitally encoded to effect illumination of a predetermined limited subset of receiver units within said range. This allows the transmitter to discriminate among certain trail marker devices.

According to still yet another aspect of the invention, the transmitter unit comprises an output power selection circuit, which operates to selectively broadcast interrogation signals having substantially different ranges. This allows the user to select a broadcast range to illuminate one or a plurality of trail marker devices.

These and other features and advantages of this invention will become apparent upon reading the following specification, which, along with the drawings, describes preferred and alternative embodiments of the invention in detail.

BRIEF DESCRIPTION OF THE DRAWINGS

The present invention will now be described, by way of example, with reference to the accompanying drawings, in which:

FIG. 9, is a perspective view of an accessory message panel for use with a trail marker receiver unit to convey information to a searcher, rescuer or subsequent passer by;

Although the drawings represent embodiments of the present invention, the drawings are not necessarily to scale and certain features may be exaggerated in order to illustrate and explain the present invention. The exemplification set forth herein illustrates an embodiment of the invention, in one form, and such exemplifications are not to be construed as limiting the scope of the invention in any manner.

DESCRIPTION OF THE PREFERRED EMBODIMENT

The present invention is primarily intended for hunters, fishermen and other sportsmen who have identified good hunting/fishing cites in the woods/wilderness to which they wish to return, and will be described in that context. Because sportsmen frequently walk through the woods during hours of dawn/dusk, or even in total darkness, the present invention provides a simple to use, hands-free device which provides a self-illuminating succession of waypoint markers defining a preferred trail. After a given time, the markers self-extinguish to enhance battery life. Only an appropriately coded transmitter carried by the user will activate the waypoint markers, ensuring secrecy and effectively hiding the trail from non-authorized users. Although described in the context of its preferred sporting usage, the present invention can be applied for many applications such as covert military and police missions, rescue/recovery of lost or injured parties, survival equipment packages and the like. Accordingly, the following description is deemed illustrative and is not to be construed as limiting.

Figure 1:
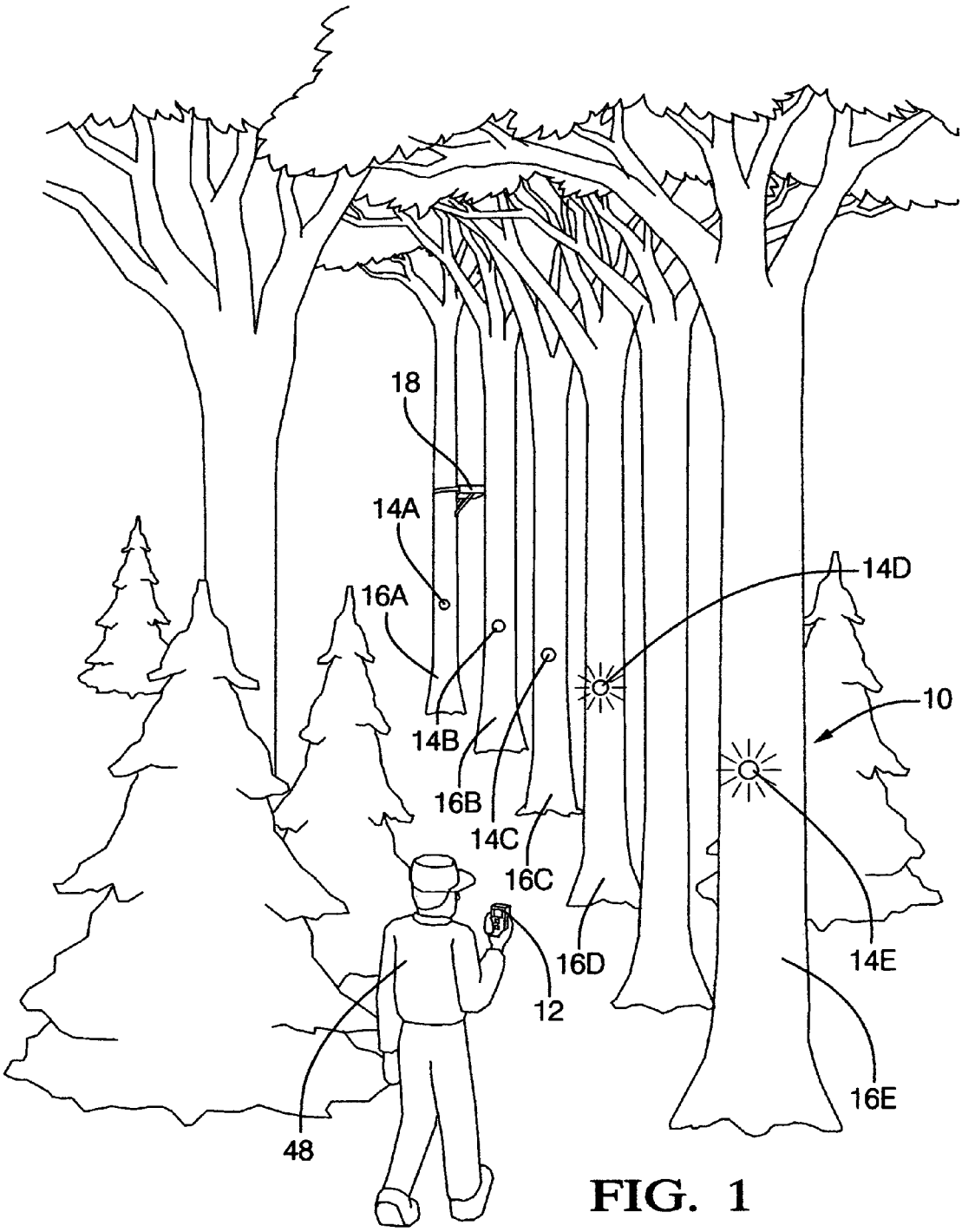
FIG. 1, is a perspective illustration of a portion of a forest trail as marked with an illuminated trail marker apparatus in accordance with the present invention.
Figure 3:
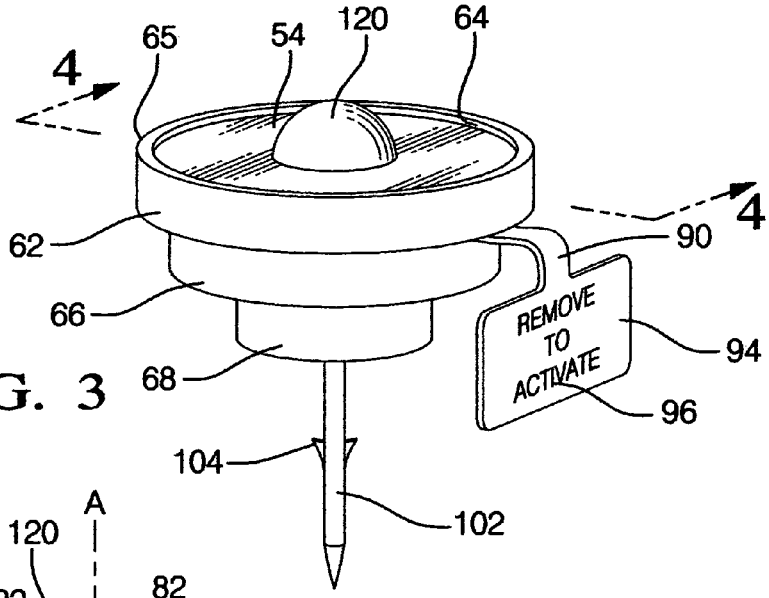
FIG. 3, is perspective plan view of the preferred embodiment of the trail marker receiver unit.

Referring to FIG. 1, the preferred embodiment of the invention comprises a trail marker apparatus or system 10 including a transmitter unit 12 (FIG. 5) and at least one trail marker device/receiver unit 14 (FIG. 3). The transmitter unit 12 contains a battery powered, digitally encoded radio frequency (RF) transmitter circuit. In application, the transmitter unit 12 is carried by the hunter by a lanyard or other suitable means and, when activated, periodically broadcasts an interrogation signal. A plurality of trail marker units 14 are pre-positioned at fixed waypoints along the trail. Successive marker units 14 are spaced to be well within the nominal effective range of the transmitter unit 12. Preferably at least several of the closest trail marker units 14, in both directions, are easily within the range of the transmitter unit 12.

Still referring to FIG. 1, the operation of the present invention will be described. It is contemplated that the trail marker system 10 would be provided with one or two transmitter units 12 and a relatively large number (perhaps 30-50) trail marker devices 14. Additional/replacement tree marker devices 14 can also be provided separately. When a desirable location is identified in a remote area, such as a tree 16A suitable for a hunting tree stand 18, the user will attach a first trail marker device 14A to tree 16A in a position such that it will be viewable from a distance in the general direction of the proposed trail and oriented such that its longitudinal axis A-A (FIG. 4) extends in that direction. The trail marker device 14A is then activated by completing an electrical circuit, as will be described in greater detail herein below. Next, the user would walk for a distance and identify a first waypoint, such as a tree 16B. After confirming that trail marker device 14A is along a direct line of sight to tree 16B, a second trail marker device 14B is installed on tree 16B and energized. Thereafter, the process is repeated whereby trail marker devices 14C-14E are installed on respective trees 16C-16E. Thus, a "marked" trail is established by the pre-positioning of a series of trail marker devices 14A-14E, which are attached to a series of trees 16A-16E, respectively.

Although FIG. 1 illustrates the placement of the trail marker devices 14A-14E in highly visible locations, in practice, they would be secreted within foliage, branches and the like, while maintaining their direct line of sight orientation with at least both immediately adjacent waypoints. This results in their being very difficult to discern unless in the illuminated state. Furthermore, although FIG. 1 suggests placement of the trail marker devices 14A-14E such that they are viewable only to a user who is moving along the trail in a direction toward the tree stand 18, in practice, they may be placed so as to be visible while walking towards and away from the tree stand 18.

Figure 2:
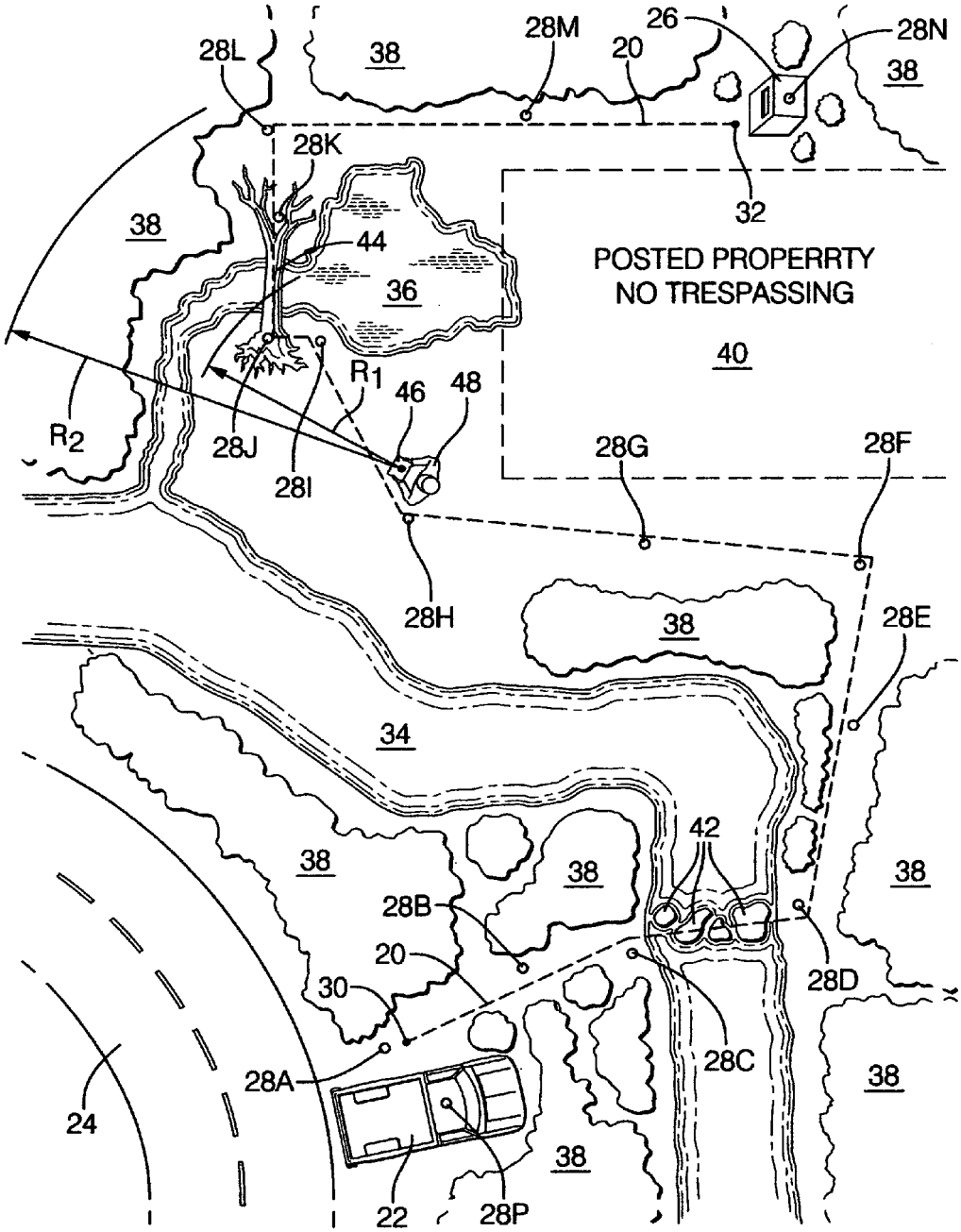
FIG. 2, is an overhead map of a wilderness trail defined by a plurality of pre-positioned inventive trail marker receiver units.

Referring to FIG. 2, an overhead view or map perspective of a marked trail 20 extending from a parked user vehicle 22 on the side of a well defined road 24 to a camouflaged hunting blind 26, is illustrated. Trail 20 is defined by a series of fourteen (14) trail marker devices 28A-28N extending from a start point 30 at or near the vehicle 22 to an end point 32 at or near the hunting blind 26. In laying out the trail 20, the user sought to avoid natural obstacles such as a river 34, swamp 36 and extremely heavy vegetation 38, as well as man-made impediments such as private/posted property 40. In addition, the trail 20 takes advantage of natural features such as rocks 42 defining a suitable river ford, and a dead-fall (tree) 44 across a narrow portion of the swamp 36.

Beginning before sunrise, the user can drive along the road 24 with a transmitter unit 46 already energized. As he (in his car 22) approaches the start point 30 of the trail 20, trail marker device 28A will become illuminated as he approaches, providing an initial orientation. After parking the car 22, he approaches trail marker device 28A and looks for device 28B, which is now also illuminated. He then walks directly toward marker 28B. As he approaches marker 28B, marker 28C has become illuminated. Thus, as he approaches marker 28B, he changes his direction to head directly for marker 28C. As he approaches marker 28C, marker 28D has become illuminated. Markers 28C and 28D are preferably placed strategically to highlight the beginning and end of the hazard (rocks 42/stream34).

After traversing the stream 34, the user continues to sequentially locate and walk toward trail marker devices 28E, 28F, 28G and 28H in succession. As the user 48 approaches marker 28H, both markers 281 and 28J become illuminated nearly simultaneously to highlight a particularly dangerous hazard, the dead-fall 44. Up to this point the user 48 has the transmitter 46 set at a low output power setting, wherein the transmitter has an effective range designated by arrow R1 and typically illuminates only one marker at a time, to minimize the possibility of being observed. If he so chooses, the user 48 can select a higher output power setting, giving the transmitter 46 an extended effective range designated by arrow R2. Insodoing, he will also illuminate markers 28K and 28L on the far side of the dead-fall 44 to assist in its traversal.

As the user 48 approaches marker 28K, he will reduce the power of the transmitter, and then continue along trail 20 by sequentially locating and then walking toward markers 28L, 28M and finally 28N, having arrived at the trail end point 32 at the hunting blind 26. Thereafter, he de-energizes the transmitter to immerse himself in darkness and begin hunting. As will be described in detail herein below, each of the trail marker devices 28 will be de-illuminated as soon as they fall outside of the effective range of the transmitter 46, or alternatively, will turn themselves off after a predetermined period of time. At the end of the hunting day, the user 48 will reverse the above described process, traversing the trail 20 from the end point 32 to the vehicle 22 near the start point 30. An extra trail marker device 28P can also be mounted or temporarily placed in an open or visible location on the vehicle 22 to further assist its location by the user 48.

Figure 4:
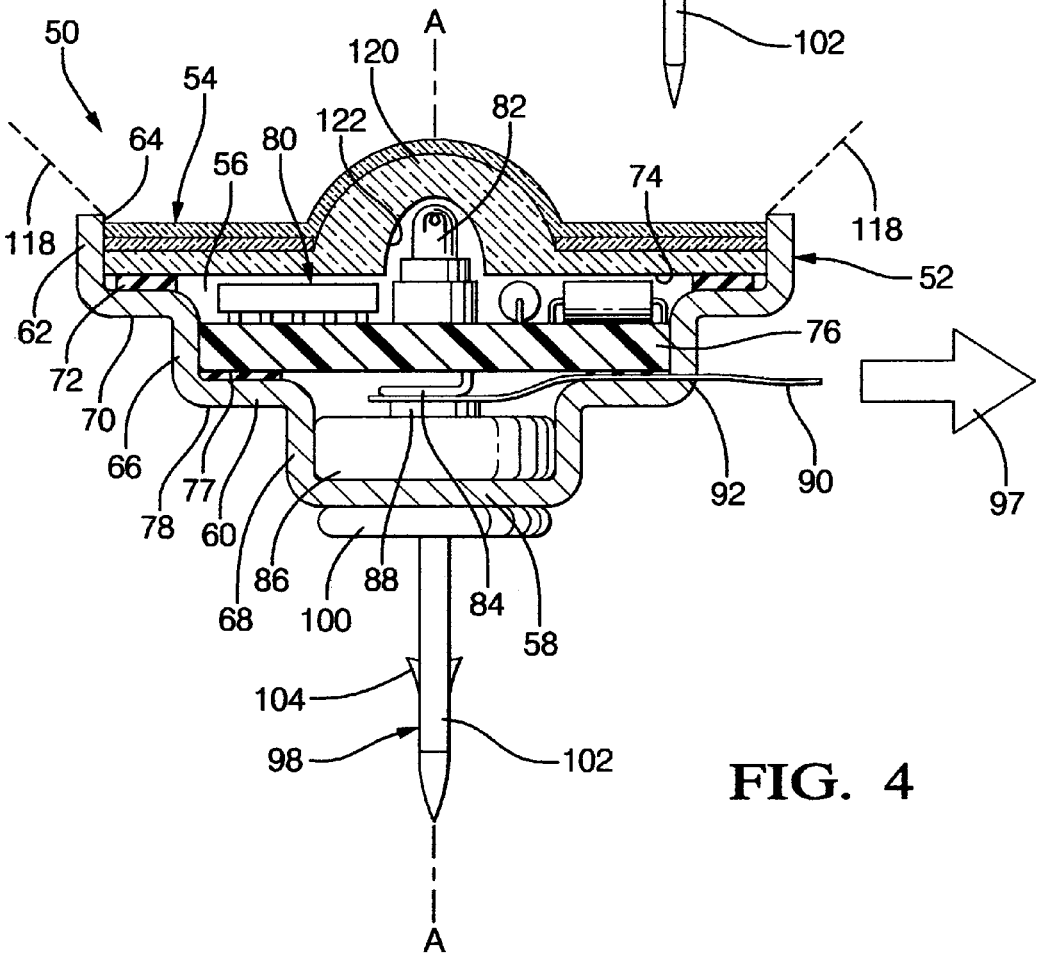
FIG. 4, is a cross-sectional view, taken on line 4-4 of FIG. 3, on an enlarged scale.

Referring to FIGS. 3 and 4, a preferred embodiment of an illustrative trail marker device 50 is illustrated. Each trail marker device 50 is adapted for pre-positioning at a specific trail waypoint, target or destination and is operative to self-illuminate in response to an actuation signal, as will be described herein below. The trail marker device 50 is designed to be relatively low cost whereby the user will not hesitate to employ them in adequate numbers (i.e., with minimized spacing there between) to maximize trail delineation and provide a degree of redundancy between adjacent devices 50, and will not be unduly concerned if a limited number of devices 50 malfunction or are lost.

Trail marker device 50 includes a housing 52 and a closure member 54, which cooperates with the housing 52, in assembly, to define a substantially closed cavity 56. Housing 52 preferably is formed of stamped mild steel, or other suitable material such as plastic, in the shape of a cup, having a bottom 58 integrally formed with a sidewall 60 which radially transitions step-wise along its longitudinal axis A-A from a maximum diameter portion 62 adjacent the open end 64 of the housing 52, to an intermediate diameter portion 66, to a minimum diameter portion 68 adjacent the bottom 58. The closure member 54 is preferably formed of optically clear plastic or other suitable material and is slip fit within the maximum diameter portion 62 of sidewall 60 and nestingly engages the radially extending portion 70 of the sidewall 60 transitioning from the maximum diameter portion 62 to the intermediate diameter portion 66. A resilient annular seal 72, formed of rubber or other suitable material, provides a hermetic seal between the inner surface 74 of closure member 54 and radially extending portion 70 of sidewall 60.

A generally annular printed circuit board (PCB) 76 is slip fit within the intermediate diameter portion 66 of the sidewall 60 and nestingly engages the radially extending portion 78 of the sidewall 60 transitioning from the intermediate diameter portion 66 to the minimum diameter portion 68 via an adhesive ring seal 77. The PCB 76 is preferably constructed of monolithic or composite plastic material, ceramic or other suitable electrically insulating material and serves to carry an array of suitable integrated circuits and discrete electrical components making up a control circuit 80 and a light source 82, such as a light emitting diode (LED). The PCB 76 also carries conductive circuit traces (not illustrated) on one or both surfaces thereof to electrically interconnect the electrical components to complete the control circuit 80 and to establish an electrical ground path from the circuit to the (electrically conductive) housing 52. A resilient electrical power input contact 84 extends below the PCB 76.

A source of electrical power such as a battery 86 is slip fit within the minimum diameter portion 68 of the sidewall 60 and nestingly engages the inner surface of the bottom 58 of the housing 52. The outer case (negative terminal) of the battery 86 is grounded to the housing 52 and the positive terminal 88 extends upwardly to engage contact 84 to provide electrical power to the control circuit 80. Many types of battery (liquid/dry cell, alkaline, lithium, silver oxide, cadmium, titanium, and the like) can be satisfactorily employed. As will be apparent herein after, other sources of electrical energy, such as a charged capacitor, a rotating induction machine or the like could be used in conjunction with or in place of a battery. This can be important in circumstances where the trail marker device 50 has been in long term storage/use and a fresh, charged battery 86 is unavailable.

Prior to usage of the trail marker device 50, the control circuit 80 can be de-energized by inclusion of an electrically insulating material such as a Mylar strip 90 to separate (and electrically isolate) the positive terminal 88 of the battery 86 and the electrical contact 84. In the preferred embodiment illustrated in FIGS. 3 and 4, the Mylar strip 90 is elongated to extend outwardly through a small opening 92 in housing 52 and terminate in an enlarged end portion 94 suitable for manual gripping and removal. The enlarged end portion 94 of the Mylar strip 90 preferably has instructional indicia 96 imprinted thereon. Accordingly, with the Mylar strip 90 in place, the trail marker device 50 can be stored for long periods of time without risk of the battery 86 becoming discharged. When the trail marker device 50 is to be activated before being mounted to define a trail, the Mylar strip 90 is simply removed, as indicated by arrow 97 (FIG. 4) and discarded or preserved for reuse when the marker is de-activated. The annular seal 77 is sufficiently resilient to self-seal the opening 92 after removal of the Mylar strip 90.

Fixation means, such as a metal spike 98, includes a generally flat head portion 100 affixed, such as by welding, to the outer surface of the bottom 58 of the housing 52 of the trail marker device 50 and rigid elongated member 102 depending outwardly there from. The elongated member 102 is preferably pointed to facilitate its impaling trees, fence posts, wooden structures, and the like with relative ease during the mounting process. Barbs 104 are formed along elongated member 102 to prevent its unintended disengagement over time due to ambient temperature cycles, relaxation of the host wood fibers/grain, contact with moving foliage or wildlife and the like.

Figure 7:
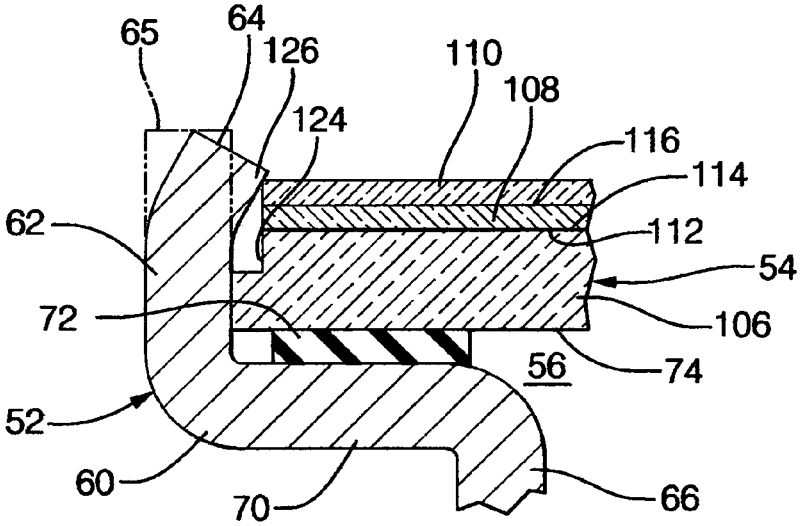
FIG. 7, is a broken, cross-sectional view of a portion of the trail marker receiver unit of FIGS. 3 and 4, on an enlarged scale.

Referring to FIG. 7, closure member 54 comprises an optically clear structural lens portion 106, an intermediate annular light scattering reflector portion 108, and an outer translucent filter portion 110. Reflector portion 108 has a mirrored second surface 112 adhered to the top surface 114 of lens portion 106. Reflector portion 108 has a geometrically scribed outer or first surface 116, preferably a series of concentric saw-tooth circles, providing a large number of reflective facets which tend to reflect received ambient and remotely projected light as well as light generated by the LED 82 outwardly in a wide conical field defined by lines 118 (refer FIG. 4) symmetrically about axis A-A.

Filter portion 110 can be made of Mylar or other suitable material which self-adheres to first surface 116 of reflector portion 108 whereby it could be easily removed and replaced by another filter portion which passes light of a different wave length (color) or, alternatively, eliminated all together.

As best viewed in FIGS. 3 and 4, the center of lens portion 106 has an integral convex lens 120 extending outwardly concentrically with axis A-A. LED 82 is located in a recess 122 formed in the inner surface 74 of lens portion 106. Thus, the lens 120 cooperates with the LED 82 body to establish a composite lens, which can be easily modified to vary its effective focal length and other operating characteristics. Lens 120 extends through a central opening in reflector portion 108. Lens 120 can be overlaid by filter portion 110 whereby all reflected/emitted light from the trail marker device 50 is a single color or, alternatively, lens 120 can also extend through a concentric central opening (not illustrated) in filter portion 110 to effect emitted light of a first color and reflected light of a distinctly different color. Furthermore, reflective portion 108 can be integrally molded with lens portion 106 with its first surface 116 being reflective. Also, filter portion 110 can be a permanent coating or integrally formed as a color pigment of the material forming lens portion 106 and/or reflector portion 108.

Referring to FIG. 7, a tool receiving recess 124 is formed in preferably three circumferentially equally spaced locations on the outer periphery of closure member 54. A localized portion of the maximum diameter portion 62 of housing 52 adjacent each tool receiving recess 124 is deformed radially inwardly to form an engagement tab 126 which extends within tool receiving recess 124 to resiliently retain closure member 54 in its illustrated position. Should the battery 86 require replacement the engagement tab(s) 126 are deformed radially outwardly by a screwdriver, knife blade or other suitable elongated tool. In usage, the tool is inserted within recess 124 and levered outwardly against the tab 126. The closure member 54 and PCB 76 are then removed to provide access to the battery 86. Once the battery 86 is replaced and the PCB 76 and closure member 54 returned to their illustrated positions, the tabs 126 are bent radially inwardly to their illustrated original positions.

Figure 5:
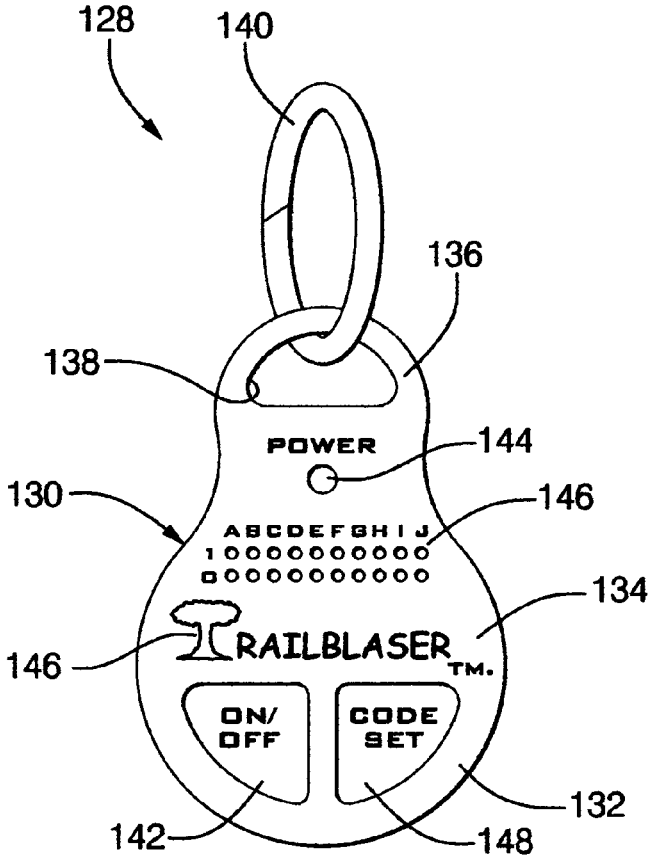
FIG. 5, is a front plan view of the preferred embodiment of the trail marker transmitter unit.

Referring to FIG. 5, a preferred embodiment of a transmitter unit 128 for use with the trail marker device 50 of FIGS. 3, 4 and 7 comprises a housing assembly 130 including a keypad portion 132, an identification portion 134 and a mounting portion 136. The housing assembly 130 is preferably two substantially mirror image housing halves constructed of injection molded plastic, which snap together to form a substantially hermetically sealed cavity containing a battery, a radio frequency transmitter and a control circuit, which will be described in greater detail herein below.

The mounting portion 136 of transmitter unit 128 defines a through hole 138 for receiving a lanyard or, alternatively, a split retaining ring 140 for use as a key fob or secured attachment to the user while he approaches/traverses a marked trail 20 (FIG. 2). Overall, the transmitter unit 128 is generally similar in size to a typical automotive remote entry system transmitter. The keypad portion 132 provides a user interface for programming and controlling operation of the transmitter unit 128. The keypad portion 132 preferably includes function specific switches, indicators and devices such as an "on-off" (i.e. push-push) switch 142, a "power on" indicator light 144, an array of digital code program set/dual inline package (DIP) switches 146 and a "code set" (i.e. push) switch 148, along with associated function indicia. As will become apparent from a reading of the description of an alternative embodiment of the invention herein below, controls/readouts for additional functions (such as continuous transmission mode or periodic transmission mode) can be added. The identification portion 134 of the transmitter unit 128 can include instructional or promotional indicia 146.

Figure 6:
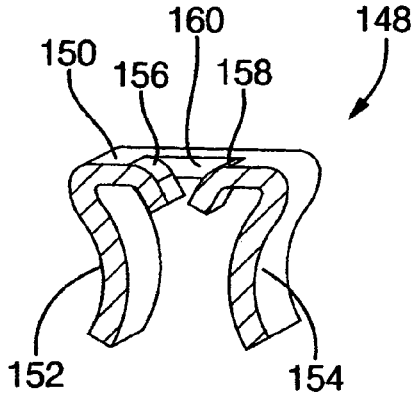
FIG. 6, is a perspective, cross-section view of a supplemental trail marker receiver unit attachment clip, on an enlarged scale.

Referring to FIG. 6, a mounting clip 148 can be applied to assist in the mounting of the trail marker device 50 (FIGS. 3 & 4) to a mounting structure providing only thin-sectioned material, such as fabric, to support the device 50. Examples could be the canvas wall of a hunting blind or shelter, or an article of clothing (either fixed to another object or worn by a guide/hunter or the like). The mounting clip 148 can be applied as a backer when the elongated member 102 of a mounting spike 98 penetrates the mounting material and extends outwardly beyond its far side.

The mounting clip 148 is generally u-shaped, and includes a base portion 150 and opposed side portions 152 and 154 cantilevered there from. A pair of opposed lanced tabs 156 and 158 are formed in the center of the base portion and extend angularly there from in the general direction of extension of the side portions 152 and 154. The lanced tabs 156 and 158 cooperate to define a through passage 160 dimensioned to establish an interference fit with the elongated member 102 of a mounting spike 98.

Figure 8:
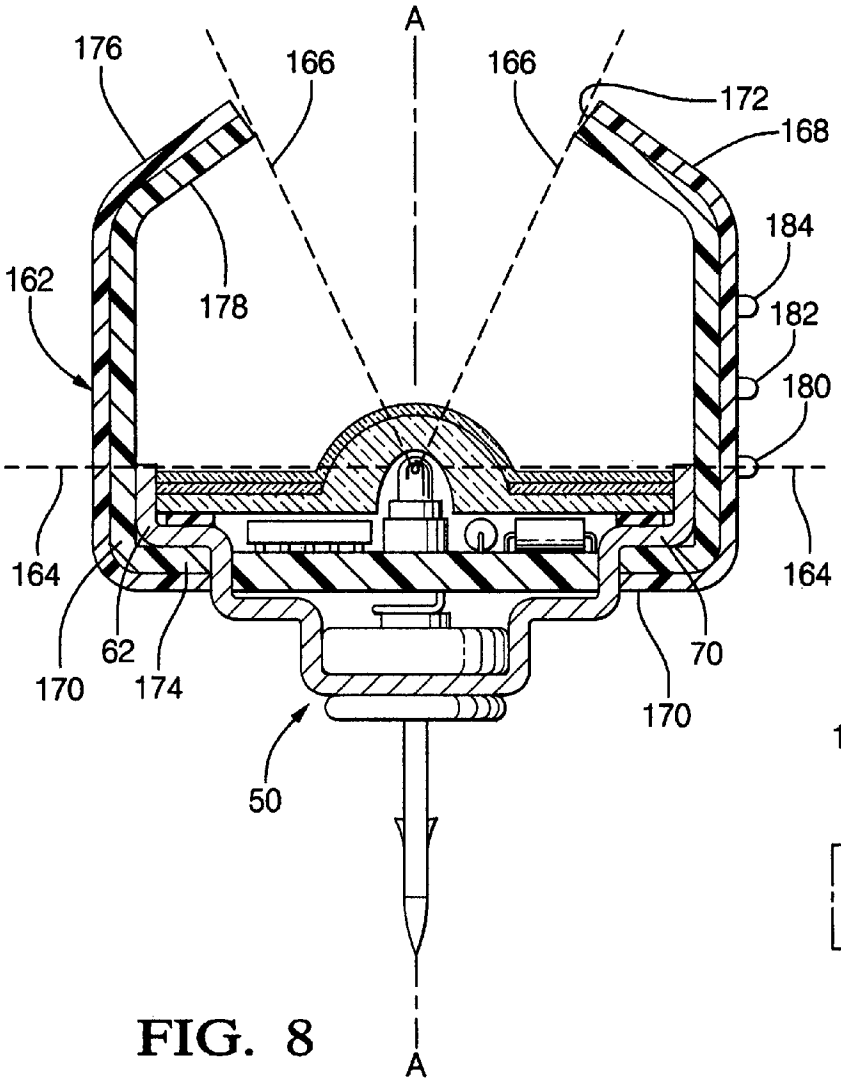
FIG. 8, is a cross-sectional view of an alternative embodiment of the trail marker receiver unit.

Referring to FIG. 8, a flexible hood 162 can be employed with the trail marker device 50 to controllably limit the effective operational viewing sector from a maximum field depicted by lines 164, to a reduced field depicted by lines 166. The viewing sector is disposed symmetrically about axis A-A, and is defined as the sector of space facing the closure member 54 of an operational trail marker device 50 within which the user can observe light emitted there from when no intermediate obstacles are present. The hood 162 would be employed when the trail marker system 10 is employed for clandestine purposes, or it is desired to define a precise line of approach to a specific trail marker device 50.

The hood 162 is preferably constructed of relatively soft, pliable vinyl, rubber, or other suitable material. The hood 162 is generally shaped as an open-ended cylinder with a tapered first end 168 and a stepped reduced radius second end 170. The first end 168 defines a restricted opening 172, which defines the size of the viewing sector based upon its effective diameter and axial spacing from the LED. The second end is configured for attachment to the trail marker device 50. The second end 170 of the hood 162 defines a step portion 174, which resiliently embraces the outer peripheral surface of the maximum diameter portion 62 and the radially extending portion 70 of the housing 52 of the trail marker device 50. As illustrated, the hood 162 has an outer surface 176 configured/colored in a camouflage motif to render it inconspicuous to an unknowing passerby and an inner surface 178 which is brightly colored (such as fluorescent or "hunter's orange") to maximize its attention attracting quality. Depending upon the user's intentions, the hood 162 can be easily removed from the trail marker device 50, inverted, and reapplied, rendering it highly visible.

As an aid in setting up a hooded trail marker device 50 so as to have a specific predetermined viewing sector size, calibration marks 180, 182 and 184 are provided on the outer surface 176 of the hood 162 which, when aligned with the opening 64 (FIG. 4) of the housing 52 of the trail marker device 50, provide viewing sectors with 60°, 90° and 120° ranges, respectively. The forgoing is to be viewed as an example only.

In application, the elongated member 102 of the mounting spike 98 would be pushed through its host fabric until the head portion 100 abuts the front surface of the fabric. The mounting clip 148 is there after applied from the rear with the elongated member 102 passing through the passageway 160 and the side portions 154 and 156 projecting rearwardly. The mounting clip 148 is displaced fully along the elongated member 102 until the leading surface of the base portion 150 abuts the rear surface of the fabric. The mounting clip 148 is removed by momentarily resiliently manually deflecting the free ends of the side portions 152 and 154 away from one another (as well as the elongated member 102). This releases the engagement of the sharp free ends of the lanced tabs from the elongated member 102. The mounting clip 148 can then be simply removed from the elongated member 102. The mounting clip 148 can be constructed of spring steel, injection molded plastic or other suitable material.

Figure 9:
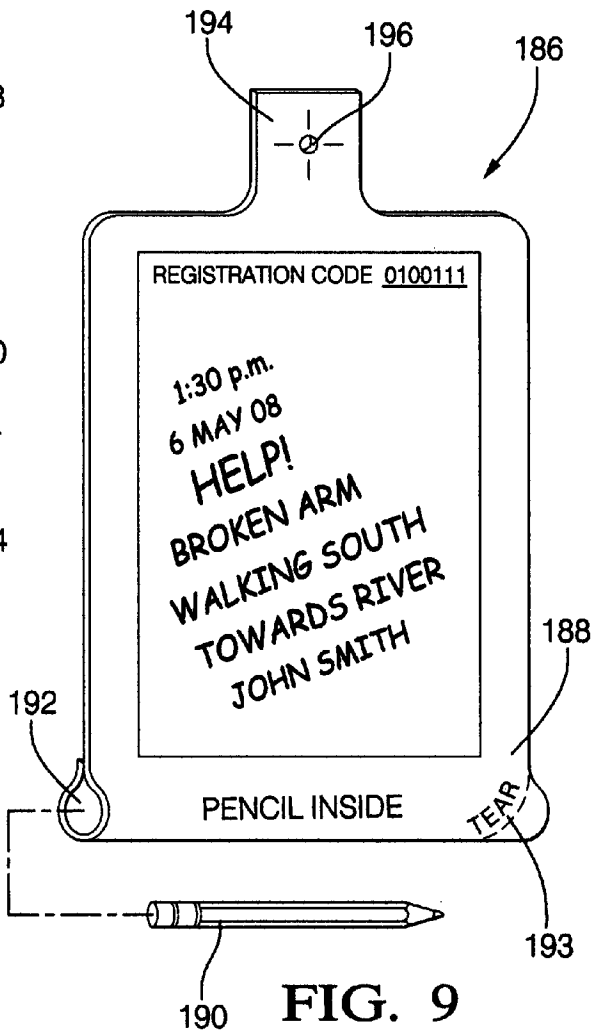

Referring to FIG. 9, a message panel/form 186 which can be used in conjunction with the trail marker system 10 is illustrated. Message form 186 is preferably constructed of opaque, lightweight material such as Mylar which is water resistant and can be rolled up for convenient, compact storage when in the field. The form 186 can be colored with either a camouflaged or brightly colored motif, depending upon its intended application. The form 186 can be color reversible, rendering it useful for both applications. The form preferably has certain instructional indicia 188 imprinted thereon and has a surface texture suitable for being used with a common writing instrument such as a pencil 190 or water resistant permanent marker.

The form 186 has one end folded over to form a hermetically sealed pocket 192 for receiving and storing the pencil 190, until its usage is required. Perforations 193 are provided in the Mylar material near one end of the pocket 192 as an aid to opening the pocket 192 for removal of the pencil 190. The form 186 also defines a fastening tab 194 adapted for securing it to an object in a fixed orientation adjacent to a trail marker device 50 by passing the elongated member 102 through a pre-punched hole 196 in fastening tab 194.

Figure 10:
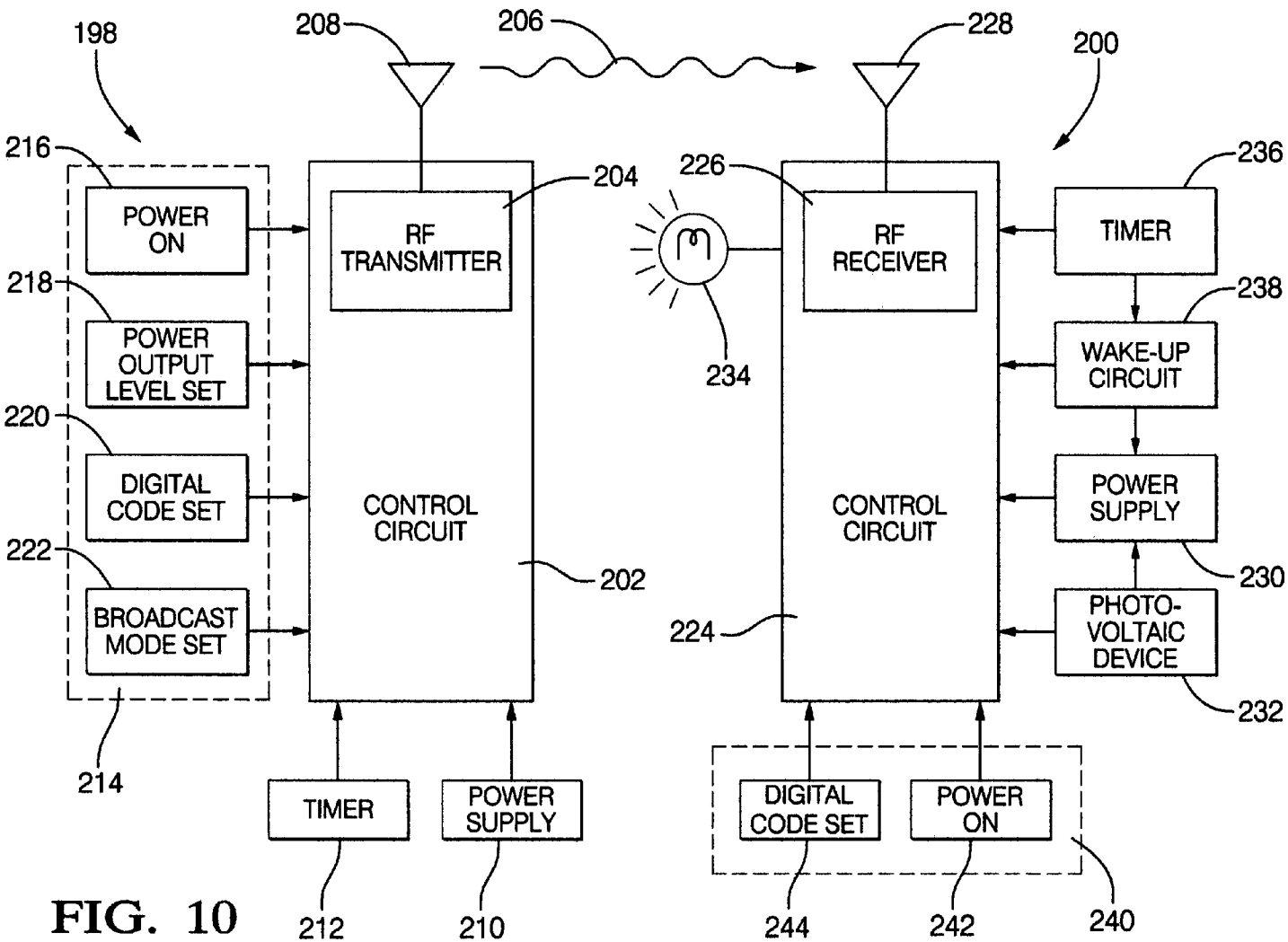
FIG. 10, is a schematic illustration of the trail marker transmitter and receiver units of a second alternative embodiment of the invention.

Referring to FIG. 10, a functional schematic diagram of a second alternative embodiment of the invention, including a transmitter unit 198 and a receiver unit 200 is illustrated. As in the case of the preferred embodiment of the invention described in connection with FIGS. 4 and 5, the transmitter unit 198 is designed to be carried with the user and the receiver unit or trail marking device 200 is designed for pre-placement at a waypoint along a marked trail.

The transmitter unit 198 includes a control circuit 202 including a radio frequency (RF) transmitter 204, which either continuously or periodically broadcasts an RF interrogation signal 206 via a transmitting antenna 208. A power supply 210, such as a battery, provides power to the transmitter unit 198. A timer circuit 212 provides timing pulses to effect periodic broadcast of RF signals 206 when in a certain operating mode.

The transmitter unit 198 also includes operator interface circuits 214 including a power on-power off switch 216, a power level set switch 218 which controls the power level (and thus range) of the RF signal 206, a digital code set circuit 220 which, with the control circuit 202, incorporates a digital identification code within the RF signal 206, and a digital code mode set circuit 222, which causes the RF transmitter to broadcast RF signals either continuously on in accordance with a timed period.

The receiver unit 200 includes a control circuit 224 including a RF receiver 226, which receives and decodes the RF interrogation signal 206 through a receiving antenna 228. A power supply 230, such as a battery or a battery in combination with a storage capacitor, provides power to the receiver unit 200. A photovoltaic device 232 provides a continuous charge current to the power supply capacitor in the presence of sufficient ambient light and provides an input signal to the control circuit 224 which can be used to control the intensity of a light source 234, such as a LED, as a function of ambient lighting conditions. A timer circuit 236 is provided to trigger a wake-up circuit 238, which, in turn, energizes the power supply 230 and the control circuit 224.

The receiver 200 also includes operator interface circuits 240 including a power on switch 242 and a digital code set circuit 244, which mimics the code established by the digital code set circuit 222 of the transmitter circuit 198. The digital encoding-decoding feature enhances operational security inasmuch as a user must have knowledge of the code settings. Preferably, the code set circuits 220 and 244 include identical DIP switches which can be identically preset by the user.

The rapid recent growth of microelectronic device technology, and particularly, the widespread usage of digital electronic systems provide one of ordinary skill in the art with many options in practicing the present invention. By way of example, systems that might be of interest in practicing the present invention are U.S. Pat. No. 5,699,065 to Murray, entitled "Remote Control Transmitter and Method of Operation", U.S. Pat. No. 5,229,649 to Nielson et al., entitled "Light-Energized Electronics Energy Management System" and U.S. Pat. No. 6,593,845 B1 to Friedman et al., entitled "Active RF Tag with Wake-Up Circuit to Prolong Battery Life". All three (U.S. Pat. No. 5,699,065, U.S. Pat. No. 5,229,649 and U.S. Pat. No. 6,593,845 B1) patents are hereby incorporated within this application by reference.

Figure 11:
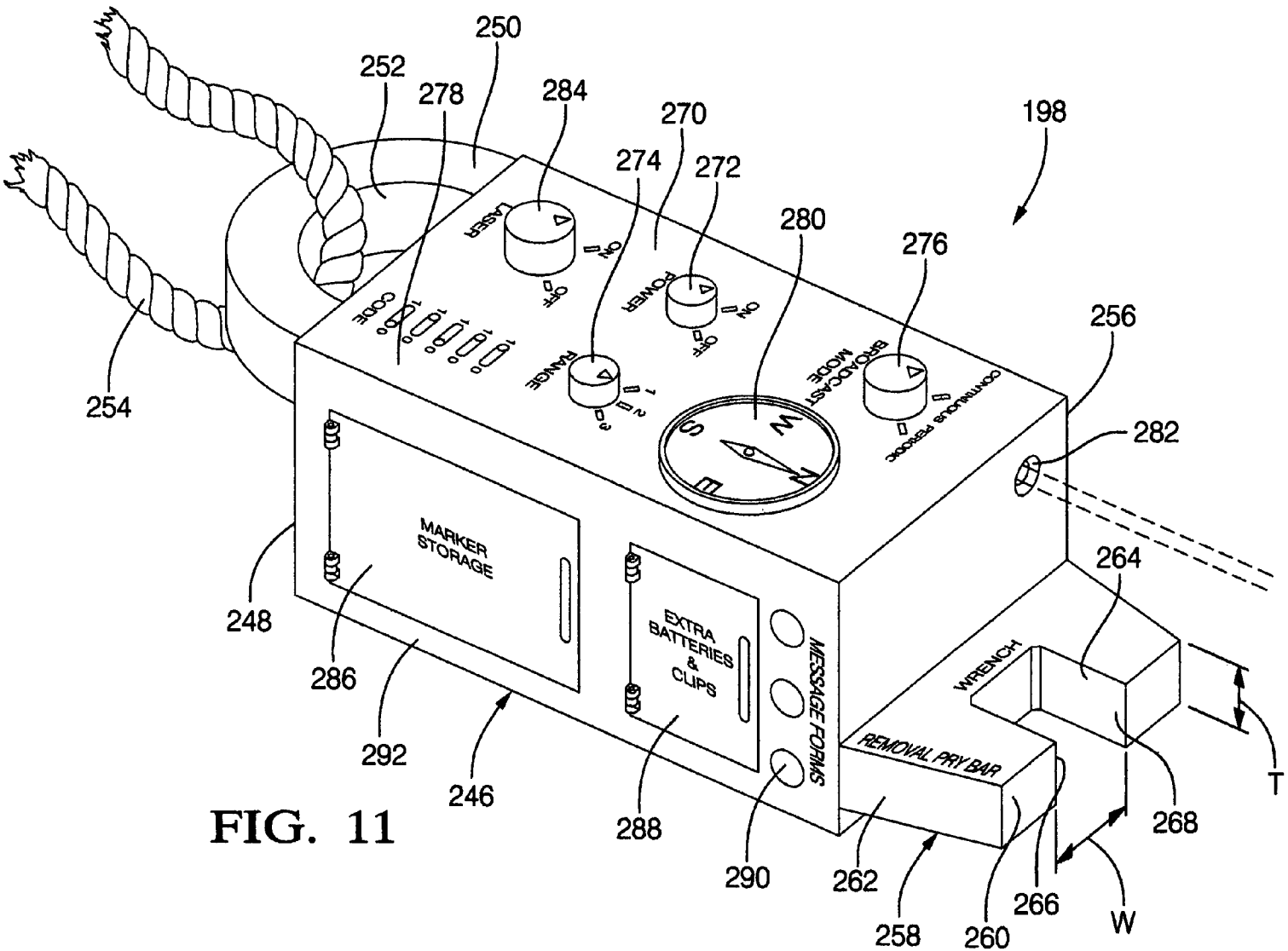
FIG. 11, is a perspective view of the transmitter portion of the second alternative embodiment of the invention illustrated schematically in FIG. 10.

Referring to FIG. 11, an exemplary configuration of the transmitter unit 198 from FIG. 10 is illustrated. Transmitter unit 198 includes a hermetically sealed housing assembly 246 formed of injection-molded plastic or other suitable material. The housing assembly 246 is generally rectangular in shape and is elongated and dimensioned to facilitate being held in the palm of the user's hand. The housing assembly 246 has a first end 248 from which an integral retention loop 250 depends. Retention loop 250 defines a through passage 252 which receives a lanyard 254 which, in use, would be worn around the user's neck for hands-free operation.

The housing assembly 246 has a second end 256 opposite the first end 248 from which extends an integral pry bar tool 258 used for removing trail marker devices from their mounted position on a tree or the like. The pry bar tool 258 is of robust design, having a nominal thickness designated "T" which is slightly less than the axial dimension of the minimum diameter portion 68 of the housing 52 of the trail marker device 50 illustrated in FIGS. 3 and 4. Tool 258 is employed by inserting a leading edge 260 or side edge 262 intermediate the radially extending portion 78 of the trail marker device 50 and the adjacent surface of the tree trunk and then applying a prying motion to the housing assembly 246 to draw the elongated member 102 from the tree trunk.

The pry bar tool 258 has a wrench tool 264 integrally formed therein. The wrench 264 is defined by two parallel surfaces 266 and 268 spaced by a dimension "W" which corresponds with a characteristic flat-to-flat dimension of a hexagonal feature on an alternative design trail marker device/receiver unit 200 as will be described herein below.

All user settable controls of the operator interface circuits 214 are disposed on the upper surface 270 of the housing assembly 246. A power on-off switch 272, a range select switch 274 and a broadcast mode select switch 276, as well as a digital code select switch array 278 are carried on the upper surface 270 of housing assembly 246. A compass 280 and a laser pointer 282 are integrated within housing assembly 246. A laser on-off switch 284 is carried on the upper surface 270 of housing assembly 246. The laser pointer 282 and compass 280 are extremely valuable additions to the trail marking system, particularly in meets and bounds plotting or laying out a trail as it is being marked.

Although the housing assembly 246 is preferably of minimal size and weight for use in the field, its utility is enhanced by the inclusion of a first closable compartment 286 for holding an adequate supply of trail marker devices and a second closable compartment 288 for holding extra batteries and mounting clips. Multiple storage nitches 290 for a supply of message forms 186 (FIG. 9) are formed in a side surface 292. When the trail marker system is employed as survival gear, matches, a reflective signaling device, first aid essentials and the like could also be stored within the housing assembly 246.

Figure 12:
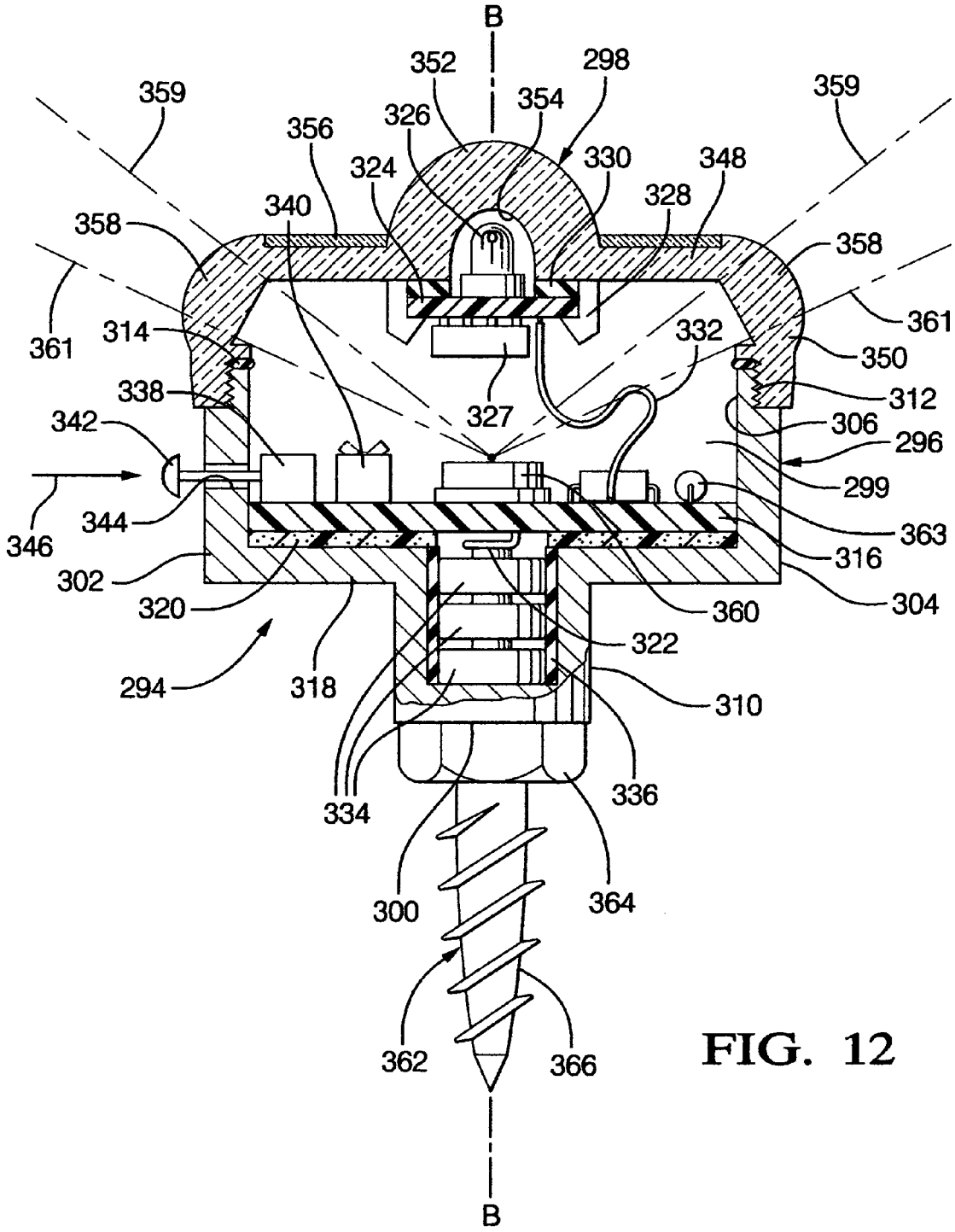
FIG. 12, is a cross-sectional view of the receiver-trail marker portion of the second alternative embodiment of the invention which can be employed with the transmitter unit of FIG. 11.

Referring to FIG. 12, an alternative embodiment of a trail marker device 294 comprising the receiver unit 200 (FIG. 10) is illustrated for usage with the transmitter unit 198 of FIG. 11. The trail marker device 294 is similar in many respects to trail marker device 50 described in connection with FIGS. 3 and 4 herein above. Thus, for the sake of brevity, only the differences will be highlighted here.

The trail marker device 294 includes a housing 296 and a closure member 298, which cooperates with the housing 296, in assembly, to define a substantially closed cavity 299. Housing 296 is formed in the shape of a cup, having a bottom 300 integrally formed with a sidewall 302 which radially transitions step-wise along its longitudinal axis B-B from a maximum diameter portion 304 adjacent the open end 306 of the housing 296, to an to a minimum diameter portion 310 adjacent the bottom 300. The closure member 298 is preferably formed of optically clear plastic or other suitable material and is removably attached to the housing 296 by cooperating thread forms 312 and a resilient gasket 314 to form a hermetic seal.

A generally annular PCB 316 is slip fit within the maximum diameter portion 304 of the sidewall 302 and nestingly engages the radially extending portion 318 of the sidewall transitioning from the maximum diameter portion 304 to the minimum diameter portion 310 via an adhesive seal ring 320. The PCB 316 serves to carry an array of suitable integrated circuits and discrete electrical components making up the receiver control circuit 200. The PCB 316 also carries conductive circuit traces (not illustrated) on one or both surfaces thereof to electrically interconnect the electrical components to complete the receiver control circuit 200 and to establish an electrical ground path from the circuit 200 to the (electrically conductive) housing 296. A resilient electrical power input contact 322 extends below the PCB 316.

A second PCB 324 supports a light source 326 such as a LED as well as additional circuit components 327. PCB 324 is affixed to the closure member 298 by a system of integral tabs 328 and a resilient spacer 330. Flexible conductors 332 interconnect the two PCBs 316 and 324.

A source of electrical power such as several serially arranged batteries 334 are slip fit within an insulating sleeve 336 disposed within the minimum diameter portion 310 of the sidewall 302. The negative terminal or case of the bottom battery 334 nestingly engages the inner surface of the bottom 300 of the housing 296 and establishes electrical contact therewith. As illustrated, the three batteries 334 are series connected, with the positive terminal of the top battery 334 electrically in circuit with the electrical contact 322.

An on-off (push-push) switch 338 and a programmable DIP switch array 340 are mounted on PCB 316. Switch 338 is part of the power on circuit 242 (FIG. 10) and includes a plunger type actuator 342 extending through a sealed bushing 344 within the sidewall 302 of housing 296. The receiver unit 200 is electrically powered by pushing and releasing the plunger 342 as indicated by arrow 346. DIP switch 340 is part of the digital code set circuit 244 (FIG. 10) and is accessed and programmed by removing the closure member 298 and manually presetting the individual switches to correspond to those of switch assembly 278 of the transmitter unit 198 (FIG. 11).

Closure member 298 is generally shaped as an inverted cup, including a top portion 348 and a circumferential skirt portion 350 integrally formed therewith from optically clear plastic. The lowermost or open end of skirt portion is affixed to the open end 306 of housing 296 via thread forms 312. An integral convex lens 352 is centrally formed on the outer surface of the top portion 348 of the closure member 298. A concave recess 354 is formed in the inner surface of the top portion 348 of closure member 298 positioned concentrically with lens 352 and axis B-B. LED 326 is disposed within recess 354. A light scattering reflector portion 356 is carried on the outer surface of the top portion 348 of the closure member 298 concentrically with lens 352.

The point of transition between the top portion 348 and skirt portion 350 of closure member 298 is thickened about its entire circumference to form a cylindrical lens 358. As depicted by lines 359 and 361, lens 358 is configured to omni-directionally focus ambient light upon a photovoltaic device 360 centrally located on PCB 316 within cavity 299. With this arrangement, sunlight received from any (360°) direction can be focused upon the photovoltaic device 360 for maintaining the electrical charge in a capacitor 362 or the batteries 334.

Fixation means 362, such as a screw shaped structure including a hexagonally shaped head portion 364, is affixed, such as by welding, to the outer surface of the bottom 300. A threaded elongated member 366 depends axially downwardly from the head portion 364. The elongated member 366 is preferably pointed and adapted to be screwed into trees, fence posts, wooden structures, and the like with relative ease during the mounting process. If necessary, the wrench 264 (FIG. 11) associated with the transmitter unit 198 can be employed to attach or remove the trail marker device 294 to its waypoint attachment structure.

The trail marker device 294 operates substantially in the same manner as the trail marker device 50 described herein above, with the principle differences that the trail marker device 294 can more easily/repeatedly be turned on and off, has a greater reserve of electrical energy by virtue of its multiple batteries, storage capacitor 363, and, most importantly, the ability to recharge itself during hours of sunlight. As a result, the trail marker device can remain in the field in an active state almost indefinitely.

Figure 13:
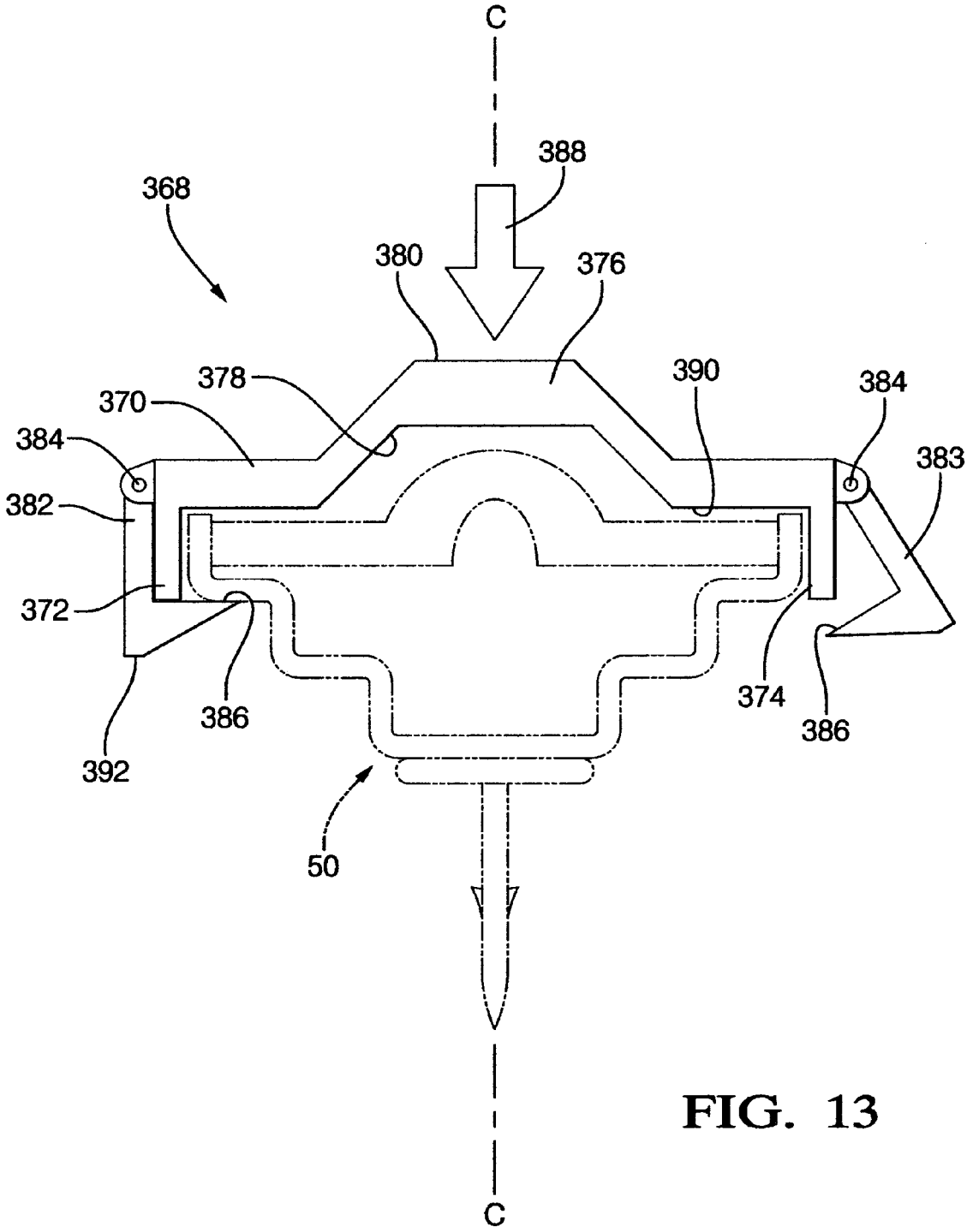
FIG. 13, is a plan view in partial cross-section of a hand-held tool for precisely positioning, mounting and removing trail marker receiver units at predetermined trail waypoints.

Referring to FIG. 13, a hand tool 368, useful for installing and removing trail marker devices 50 is illustrated. The open end 64 of the housing 52 defines a tool receiving abutment surface 65 (FIGS. 3 and 7). Hand tool 368 has a generally inverted cup shape including a top portion 370 and a peripheral skirt portion 372 formed integrally from relatively heavy gauge cast or stamped steel. The hand tool is configured and dimensioned to nestingly receive a trail marker device 50 (in phantom) within a cavity formed therein. Top portion 370 defines an upstanding central portion 376 forming a central pocket 378 within the cavity 374. The upper surface of the upstanding portion 376 of the top portion 370 forms a striking surface 380. Two or more circumferentially opposed latches 382 and 383 are pivotally affixed to the outer surface of the hand tool 368 via hinges 384. Each latch 382 and 283 forms an upwardly facing abutment surface 386. Latch 382 is illustrated in an engaged position and latch 383 is illustrated in a released position.

The hand tool 368 operates to allow a trail marking device 50 to be affixed to a tree or other suitable object at a waypoint by a single blow from a hammer, rock, or other suitable device indicated by arrow 388. The hand tool is employed to install a trail marking device 50 by first nestingly positioning the trail marking device 50 within the cavity until the tool abutment surface 65 Contacts the inner surface 390 about the entire circumference of the housing 52. This allows the distribution of the striking force about the entire circumference of the housing 52 of the trail marker device 50. The pocket provides clearance is maintained from the relatively fragile closure member/lens assembly 54. Furthermore, the tool 368 aligns the striking surface 380 normally to and concentric with the axis C-C, ensuring that the force of the blow is directed axially through the elongated member 102 into the attachment object (tree).

The hand tool 368 can be employed to remove a trail marker device 50 from an installed position by first placing the tool in the illustrated position vis-à-vis the trail marker device 50 and then folding the latches from the release position to the engaged position. Finally, a lever device (not illustrated) is inserted between the lowermost surface 392 and the object to which the trail marker device is mounted. A prying motion of the lever device will withdraw the elongated member 102 from the object. This allows the application of relatively high force loads without damaging the relatively fragile components of the trail marker device.

It is to be understood that the invention has been described with reference to specific embodiments and variations to provide the features and advantages previously described and that the embodiments are susceptible of modification as will be apparent to those skilled in the art.

Furthermore, it is contemplated that many alternative, common inexpensive materials can be employed to construct the basis constituent components. Accordingly, the forgoing is not to be construed in a limiting sense.

The invention has been described in an illustrative manner, and it is to be understood that the terminology, which has been used is intended to be in the nature of words of description rather than of limitation.

Obviously, many modifications and variations of the present invention are possible in light of the above teachings. For example, it is contemplated that a transmitter unit, such as that identified by reference numeral 198 in FIG. 11 could be integrated with a flashlight. The flashlight could emit light in either the visible frequency spectrum or in the non-visible frequency spectrum (ex. infrared, ultraviolet, and the like).

The flashlight would preferably be oriented to emit light through the second end 256 of the housing assembly 246. The function switch 284 could be reconfigured to control both the flashlight and the laser pointer 282. Furthermore, the hand tool 368 described in connection with FIG. 13 would preferably also be integrated into the housing assembly 246 of FIG. 11 to enhance its overall utilitarian value. It is, therefore, to be understood that within the scope of the appended claims, wherein reference numerals are merely for illustrative purposes and convenience and are not in any way limiting, the invention, which is defined by the following claims as interpreted according to the principles of patent law, including the Doctrine of Equivalents, may be practiced otherwise than is specifically described.

The invention claimed is:

1. A trail marker device adapted for prepositioning in a substantially fixed predetermined orientation at a specific trail waypoint or destination and operative to self-illuminate in response to an actuation signal, said trail marker device comprising:

a housing;

a closure member cooperating with said housing to define a substantially sealed cavity;

a light source;

a first optical lens juxtapositioned with said light source to focus and project light emitted by said light source within a predetermined viewing sector disposed about a focus axis and extending outwardly from said device;

a light reflector disposed adjacent said first lens concentric with said focus axis and configured to re-direct light received from said light source into said viewing sector, and to reflect light received from a remote source located in said viewing sector back along said viewing sector towards said remote source;

a field-reconfigurable opaque hood disposed concentrically about said focus axis and extending outwardly from said housing, said hood operative to selectively reduce or limit said viewing sector;

a power supply; and a control circuit at least partially disposed within said cavity and operative to selectively electrically interconnect said light source and power supply to effect externally viewable illumination.

2. The trail marker device of claim 1, wherein said control circuit comprises a receiver operative to generate said actuation signal in response to receiving an interrogation signal from a remote transmitter.

3. The trail marker device of claim 2, wherein said interrogation signal is in the radio frequency band.

4. The trail marker device of claim 1, wherein said control circuit comprises a wake-up circuit and a timer operative to generate or disable said actuation signal at a predetermined time of day.

5. The trail marker device of claim 1, wherein said power supply comprises a battery.

6. The trail marker device of claim 1, wherein said power supply comprises a photovoltaic device disposed to receive ambient light, and an electrical energy storage device.

7. The trail marker device of claim 6, wherein said energy storage device comprises a capacitor.

8. The trail marker device of claim 1, wherein said lens is integrally formed with said closure member.

9. The trail marker device of claim 1, wherein said closure member is releasably affixed to said housing.

10. The trail marker device of claim 9, further comprising at least one tool receiving recess formed in an outer circumferential surface of said closure member and a cooperating engagment tab formed on an adjacent edge of said housing, wherein said tab is selectively deformed inwardly within said recess to interconnect said housing and closure member.

11. The trail marker device of claim 1, further comprising fixation means operative to secure said trail marker device to a trailside object in said predetermined fixed orientation.

12. The trail marker device of claim 11, wherein said fixation means comprises a sharpened rigid elongated member affixed to and extending outwardly from said housing. said elongated member having a line of elongation concentrically aligned with said focus axis.

13. The trail marker device of claim 12, further comprising a tool receiving surface defined on an outer surface of said device disposed generally normal to the axis of elongation of said sharpened member.

14. The trail marker device of claim 1, wherein at least a portion of selected outer surfaces of said device is camouflaged to restrict visibility of said device from a viewing orientation outside of said viewing sector.

15. The trail marker device of claim 1, further comprising means operative to effect the emission of substantially monochromatic light from said device.

16. The trail marker device of claim 15, wherein said means operative to effect the emission of substantially mono-chromatic light comprises a translucent light filter overlaying said light source.

17. The trail marker device of claim 1, further comprising switch means operative to electrically isolate said power supply from said control circuit.

18. The trail marker device of claim 1, wherein said light source operates to emit light in at least one of the following frequency spectrums, infrared, visible light and ultraviolet.

19. A remotely actuated trail marker apparatus comprising:

a transmitter unit adapted to be carried by a user and operative to selectively broadcast an interrogation signal throughout a predetermined range; and at least one receiver unit adapted for prepositioning in a substantially fixed orientation at a specific trail waypoint or destination and operative to generate a user sensible reply signal in response to receiving said interrogation signal, said receiver unit comprising:

a housing;

a closure member cooperating with said housing to define a substantially sealed cavity;

a light source;

a first optical lens juxtapositioned with said light source to focus and project light emitted by said light source within a predetermined viewing sector disposed about a focus axis and extending outwardly from said device;

a light reflector disposed adjacent said first lens concentric with said focus axis and configured to re-direct light received from said light source into said viewing sector, and to reflect light received from a remote source located in said viewing sector back along said viewing sector towards said remote source;

a field-reconfigurable opaque hood disposed concentrically about said focus axis and extending outwardly from said housing, said hood operative to selectively reduce or limit said viewing sector;

a receiver power supply; and a receiver control circuit at least partially disposed within said cavity and operative to selectively electrically interconnect said light source and power supply to effect externally viewable illumination.

20. The trail marker apparatus of claim 19, wherein said transmitter unit comprises:

a transmitter power supply, a radio frequency transmitter including a transmitting antenna, a transmitter control circuit operative to selectively interconnect said transmitter power supply and radio frequency transmitter for transmitting said interrogation signal, and a transmitter housing substantially enclosing said transmitter and transmitter control circuit, and wherein said at least one receiver unit comprises:

a radio frequency receiver including a receiving antenna, and said receiver control circuit is interconnected with said receiver power supply, receiver and light source and operative to illuminate said light source in response to receiving said interrogation signal; and said receiver housing substantially encloses said receiver and receiver control circuit.

21. The trail marker apparatus of claim 19, wherein said interrogation signal is digitally encoded to effect illumination of a predetermined limited subset of receiver units within said range.

22. The trail marker apparatus of claim 19, wherein said transmitter unit comprises an output power selection circuit operative to selectively broadcast interrogation signals having substantially different ranges.

23. The trail marker apparatus of claim 19, wherein said interrogation signal is generated within a radiation frequency band selected from radio frequency, audio frequency, infrared, visible light and ultraviolet.

24. The trail marker device of claim 1, further comprising a plurality of spaced calibration marks disposed on a surface of said hood for effecting an objective calibration of said viewing sector by selectively excising a portion of said hood.

25. The trail marker device of claim 6, further comprising a second optical lens operative to effect focusing of ambient light upon said photovoltaic device.

26. The trail marker device of claim 25, wherein said closure member is formed of optically clear material, and said first and second optical lenses are integrally formed therein.

27. The trail marker device of claim 25, wherein said second optical lens extends circumferentially at least partially about the outer periphery of said closure member to effect substantially omni-directional receipt of ambient light.

28. The trail marker device of claim 1, further comprising an externally visible message panel defining a writing surface adapted to be affixed to said marker device.

29. The trail marker device of claim 28, wherein said message panel forms a frangible pocket containing a writing implement.

30. The trail marker apparatus of claim 19, further comprising a tool for setting and releasing trail marker devices, wherein said tool is integrally formed with said transmitter housing to provide mechanical advantage to the user.

31. The trail marker device of claim 1, wherein said hood is removably affixed to said housing and is formed of relatively thin, flexible material in a generally cylindrical configuration defining an inner surface and an outer surface, wherein one of said surfaces is imprinted in a camouflage motif and the other of said surfaces is imprinted in a brightly colored attention-attracting motif, and wherein said hood is field-reversible to selectively expose one of said surfaces to viewers located outside of said viewing sector.

32. A reconfigurable trail marker device adapted for prepositioning in a substantially fixed predetermined orientation at a specific trail waypoint or destination and operative to self-illuminate in response to an actuation signal, said trail marker device comprising:

a housing;

a closure member formed of optically clear material releasably affixed to and cooperating with said housing to define a substantially sealed cavity;

a light source;

a first optical lens juxtapositioned with said light source to focus and project light emitted by said light source within a predetermined viewing sector disposed about a focus axis and extending outwardly from said device;

a light reflector disposed adjacent said first lens concentric with said focus axis and configured to re-direct light received from said light source into said viewing sector, and to reflect light received from a remote source located in said viewing sector back along said viewing sector towards said remote source;

a fixation device operative to secure said trail marker device to a trailside object in said predetermined fixed orientation and including a sharpened rigid elongated member affixed to and extending outwardly from said housing, said elongated member having a line of elongation concentrically aligned with said focus axis;

a field-reconfigurable opaque hood disposed concentrically about said focus axis and extending outwardly from said housing, said hood operative to selectively reduce or limit said viewing sector, wherein said hood is removably affixed to said housing and is formed of relatively thin, flexible material in a generally cylindrical configuration defining an inner surface and an outer surface, wherein one of said surfaces is imprinted in a camouflage motif and the other of said surfaces is imprinted in a brightly colored attention-attracting motif, wherein said hood is field-reversible to selectively expose one of said surfaces to viewers located outside of said viewing sector, and wherein said hood further comprises a plurality of spaced calibration marks disposed on at least one of said surfaces for effecting an objective calibration of said viewing sector by selectively excising a portion of said hood;

a power supply including a battery, a photovoltaic device disposed to receive ambient light and an electrical storage device;

a control circuit at least partially disposed within said cavity and operative to selectively electrically interconnect said light source and power supply to effect externally viewable illumination, wherein said control circuit includes a receiver operative to generate said actuation signal in response to receiving a radio frequency interrogation signal from a remote transmitter, wherein said control circuit further includes a wake-up circuit and a timer operative to generate or disable said actuation signal at a predetermined time of day;

switch means operative to electrically isolate said power supply from said control circuit;

at least one tool receiving recess formed in an outer circumferential surface of said closure member and a cooperating engagement tab formed on an adjacent edge of said housing, wherein said tab is selectively deformed inwardly within said recess to interconnect said housing and closure member; and a second optical lens operative to effect focusing of ambient light upon said photovoltaic device, wherein said first and second optical lenses are integrally formed in said closure member, and wherein said second optical lens extends circumferentially about the outer periphery of said closure member to effect on-mi-directional receipt of ambient light.

* * * * *